United States Patent [19]

Lynch

[11] 4,053,066

[45] Oct. 11, 1977

[54] ARTICLE STACKING AND LOADING APPARATUS

[75] Inventor: Joseph A. Lynch, Westwood, N.J.

[73] Assignee: Nabisco, Inc., East Hanover, N.J.

[21] Appl. No.: 747,240

[22] Filed: Dec. 3, 1976

[51] Int. Cl.[2] ..... B65G 57/00

[52] U.S. Cl. ..... 214/7; 53/159; 198/431; 198/493; 214/6 S

[58] Field of Search ..... 214/6 C, 6 S, 7; 53/159; 198/431, 493; 302/31

[56] References Cited

U.S. PATENT DOCUMENTS

| | | | |
|---|---|---|---|
| 1,279,562 | 9/1918 | Lowell | 198/425 X |
| 2,345,310 | 3/1944 | Willoughby | 214/7 X |
| 2,936,557 | 5/1960 | Fay | 214/7 X |
| 3,071,236 | 1/1963 | Hahn et al. | 198/425 X |
| 3,337,064 | 8/1967 | Mojden et al. | 214/7 |
| 3,538,992 | 11/1970 | Chauhan | 198/431 |
| 3,734,567 | 5/1973 | Fong | 302/31 X |
| 3,876,083 | 4/1975 | Evans et al. | 214/7 |

*Primary Examiner*—L. J. Paperner

*Attorney, Agent, or Firm*—Gerald Durstewitz; Paul E. O'Donnell, Jr.

[57] ABSTRACT

Apparatus for stacking articles in columns and loading the columns into conveyor buckets in side-by-side relationship in which articles are fed by a conveyor to a set of dual wheels having article engaging serrations. The wheels carry the articles downwardly and set them on edge on a pair of rails extending downwardly at an angle from between the wheels. An air blast starts the articles down the rails and air jets along the rails keep the articles upright and moving along the rails. The first article in the column is supported by a finger which extends upwardly between the rails and moves from the wheels toward a turret at a rate about equal to that of the growth of the column. The rails lead to a turret having its axis parallel to the rails and having pockets for receiving columns of articles. A conveyor positioned over the turret carries projecting plates which extend downwardly for supporting the article column as it is moved into the turret recess. The finger moves the column up to the turret at which point one of the plates receives the column until the column is completed. The plate is moved slowly and it then moves rapidly to the bottom of the turret.

8 Claims, 16 Drawing Figures

Fig. 11
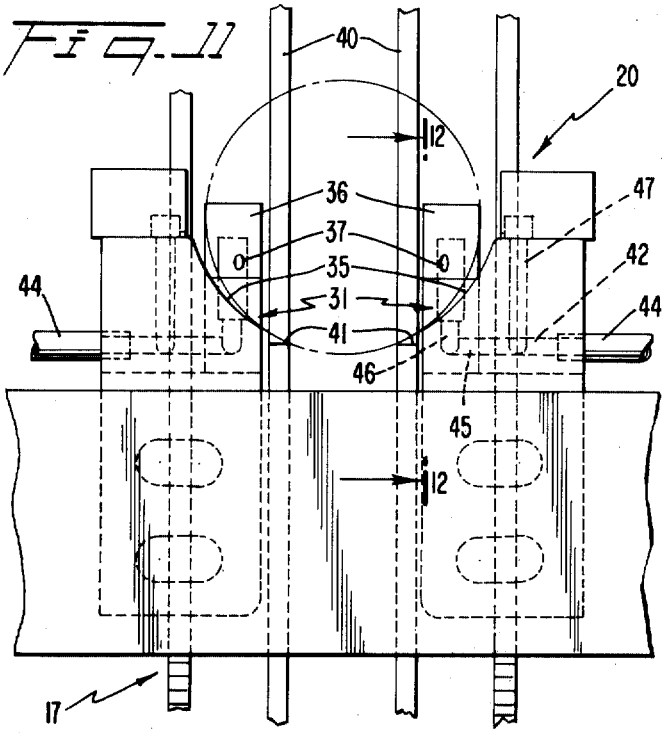
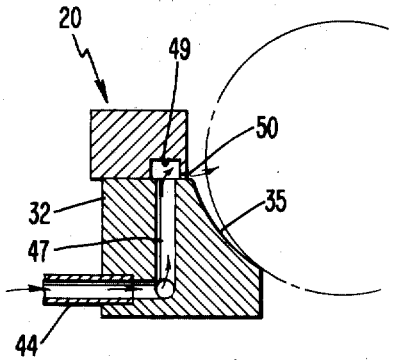
Fig. 14
Fig. 12
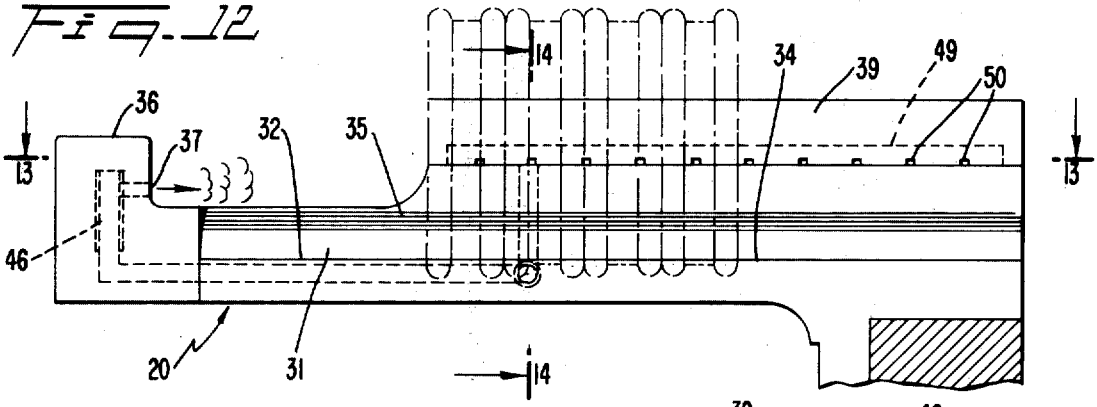
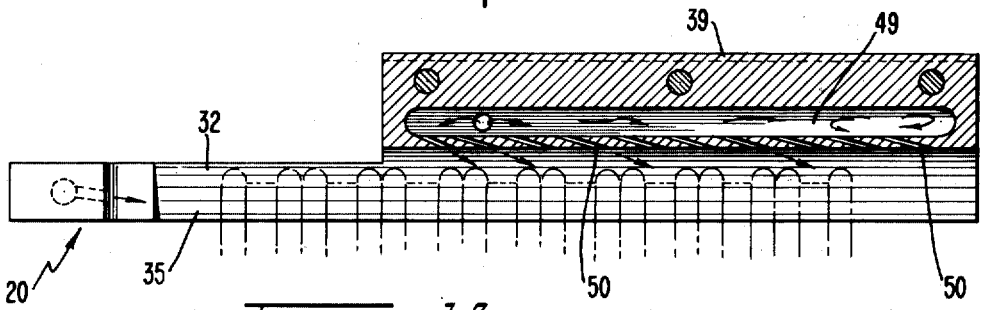
Fig. 13

ARTICLE STACKING AND LOADING APPARATUS

BACKGROUND OF THE INVENTION

The present invention relates to article loading machinery, and more particularly, to machinery for forming columns of articles of a predetermined length and depositing the columns of articles into conveyor buckets.

In one type of article stacking and loading apparatus used in the past, articles such as cookies are stacked onto inclined rails, on edge, to form a column. As each column is being formed, it slides down the rails under gravity toward a recess in a rotatable turret. When the colunn is complete, a pair of plate members mounted on a conveyor engage each end of the column and move it rapidly into the turret recess. After each column is positioned in the turret, the turret rotates to drop a column of articles into a bucket of a bucket conveyor and to present an empty recess to the stacking apparatus. Any significant variation in the column length due to a change in the thickness of the articles causes a malfunction of the apparatus. When such apparatus is used in connection with sandwich cookies, the thickness of the cookies changes if the icing depositor goes out of adjustment and too much or too little icing is deposited. When the column of cookies is too long, it will not fit between the plate members that move it into the turret. This results in the breaking of a least the last cookies in the column as the plate member collides with that cookie rather than moving in behind it. When the column is significantly shorter than the distance between the plates, the last cookie or two will not remain upright as the column moves into the turret recess and may, therefore, protrude from the turret and be smashed when the turret rotates.

When it is desired to use the apparatus to form columns of different length, because a different number of articles are placed in each column, or articles of a different thickness are to be used, or both, it is necessary to make major changes in the apparatus. The turrets must be changed for ones having the new column length, and the chain conveyor must be changed for one of a different length having plates uniformly spaced at the new column length.

The necessary parts changes require a considerable number of man hours, so that, the line being changed over is commonly out of service for one full shift. After production is resumed, much product is destroyed by malfunctioning of the machine while adjustments are made to synchronize the various mechanisms of the apparatus. Due to these factors, the changeover of such prior art machines from one column length to another entailed a considerble cost to the manufacturer.

SUMMARY OF THE INVENTION

An object of the present invention is to provide article stacking and loading apparatus which is capable of rapid modification to form and handle article stacks having different characteristics.

The object of the invention is generally accomplished by providing an article stacking and loading apparatus comprising a pair of inclined rails, a wheel device for placing the articles on edge on the rails, nozzle means for directing a jet of air generally parallel to the rails against each article as that article is transferred from the wheel to the rails, air nozzle means provided along said rails for sliding the articles along the rails and maintaining them in an upright condition, a turret rotatable about an axis parallel to the rails having a plurality of recesses for receiving columns of articles, a finger mounted for movement along the rails to the turret for engaging the first article in a column being formed to support the column, and conveyor means adjacent the turret having projecting members equally spaced at a distance comparable to the length of the turret for supporting each column and moving the columns into the turret recesses.

BRIEF DESCRIPTION OF THE DRAWING

A preferred embodiment of the invention has been chosen for purposes of illustration and description, and is shown in the accompanying drawing, forming a part of the specification wherein:

FIG. 11 is an end view of the air rails as viewed along line 11—11 on FIG. 5 with the articles and conveyor plate removed.

FIG. 12 is a sectional view taken along line 12—12 on FIG. 11.

FIG. 13 is a sectional view taken along line 13—13 on FIG. 12.

FIG. 14 is a sectional view taken along line 14—14 on FIG. 12.

DESCRIPTION OF THE PREFERRED EMBODIMENT

Figure 3:
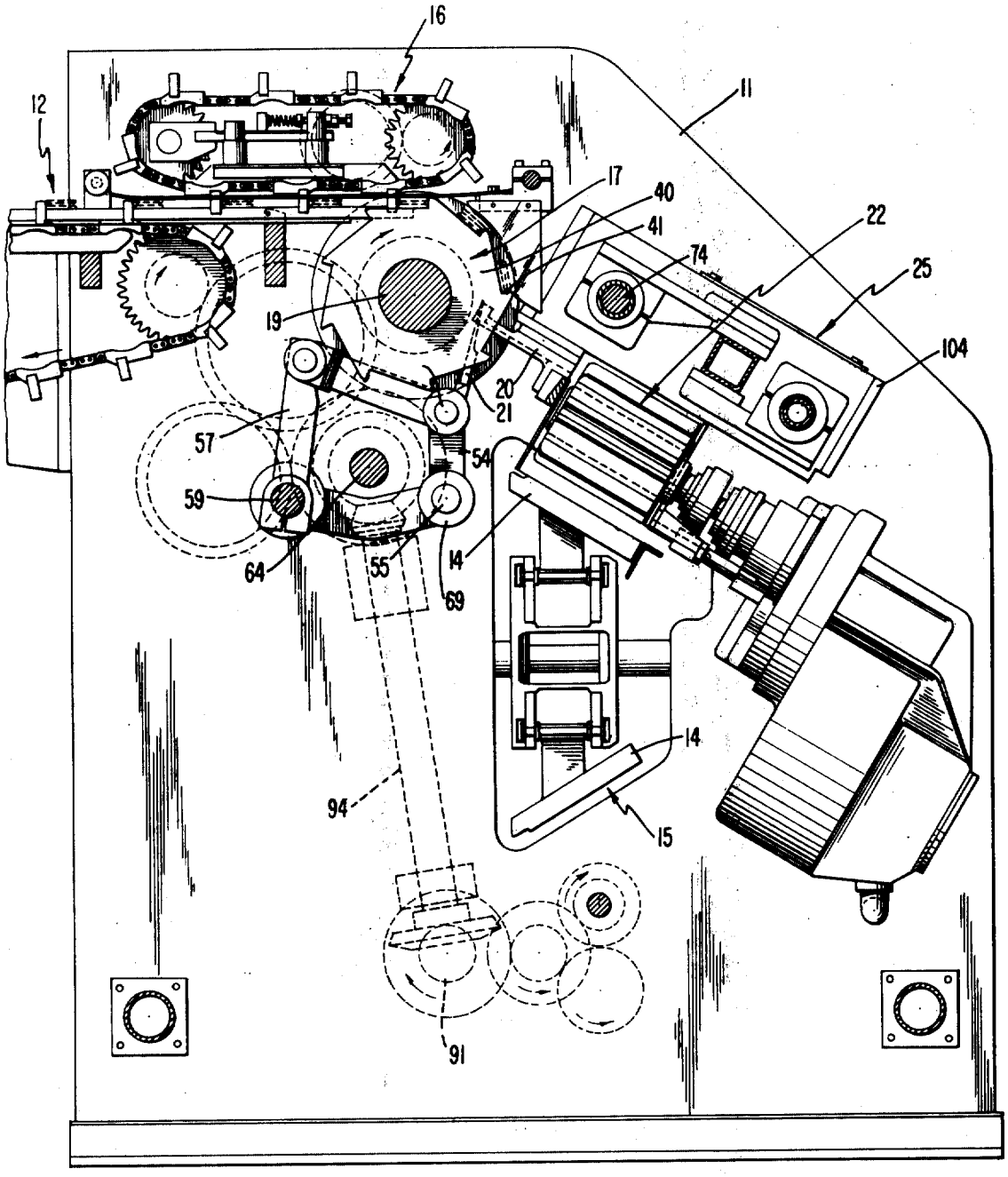
FIG. 3 is a sectional view taken along the line 3—3 on FIG. 1.

With reference to the drawings, there is shown article stacking and loading apparatus which includes a pair of end frame plates 10 and 11 upon which the various mechanisms of the apparatus are mounted. The apparatus receives articles from a plurality of infeed conveyors 12, shown in FIGS. 3 and 7, which are positioned side by side between the end frame plates. In the preferred embodiment, each conveyor 12 carries a single line of sandwich cookies to the apparatus. The apparatus stacks the cookies in each line into columns containing a predetermined number of cookies and the columns thus formed are deposited into the buckets 14 of a bucket conveyor 15. The conveyor 15 transports the columns to a packaging station where a number of columns are positioned side by side within a package.

As shown in FIGS. 3 to 7, each line of cookies is moved by an overhead transfer conveyor 16 from the infeed conveyor 12 to a stacking wheel 17. The stacking wheels 17 are mounted in side by side relationship on a shaft 19 that is driven in a clockwise direction as viewed in the drawings. The cookies in each line are carried by the stacking wheel down to a pair of inclined rails 20 and deposited on edge upon the rails to form a column. The column is supported by a finger 21 which extends upwardly between the rails and moves continuously away from the stacking wheel as the column is formed.

Figure 7:
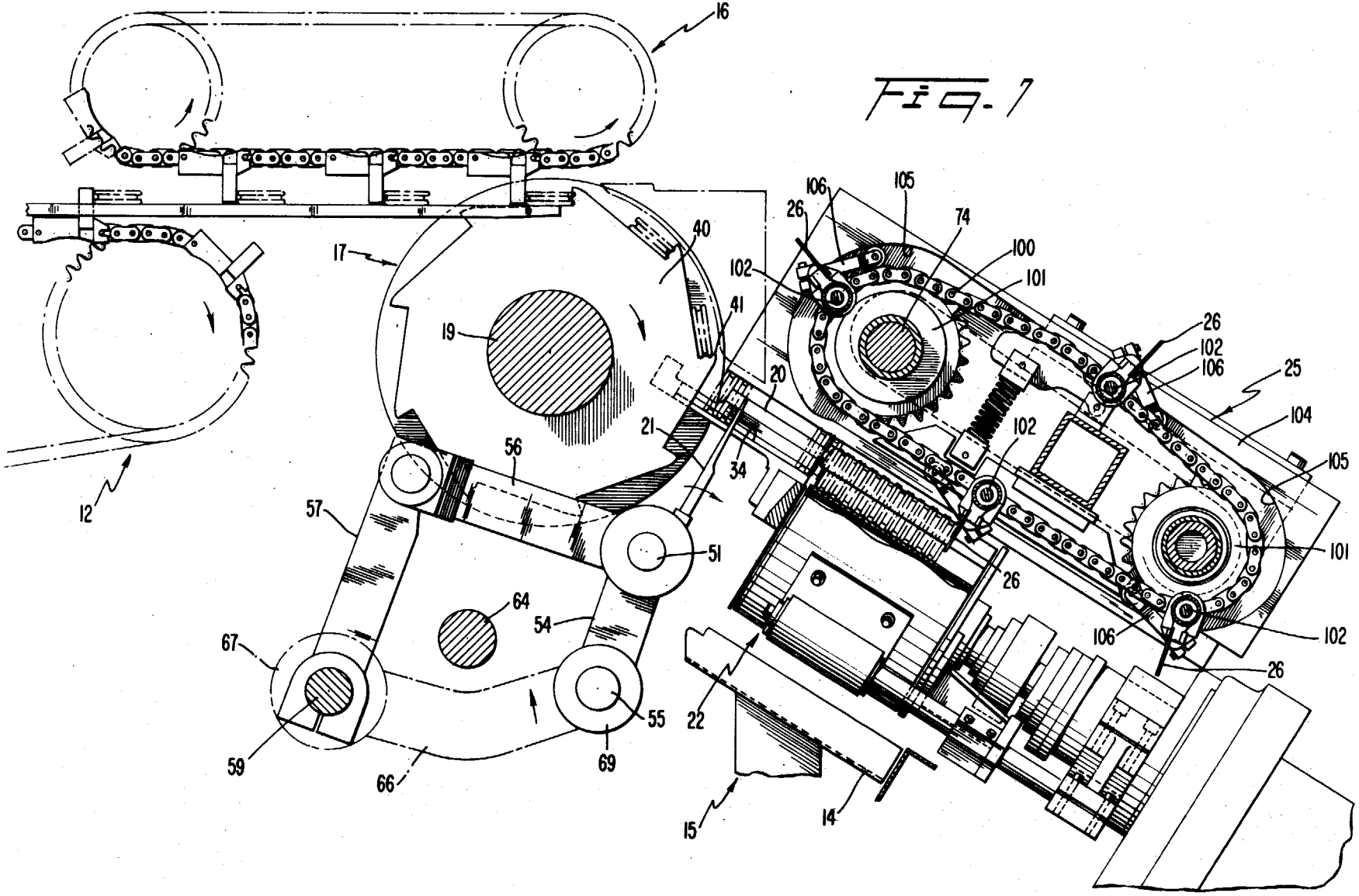
Figure 8:
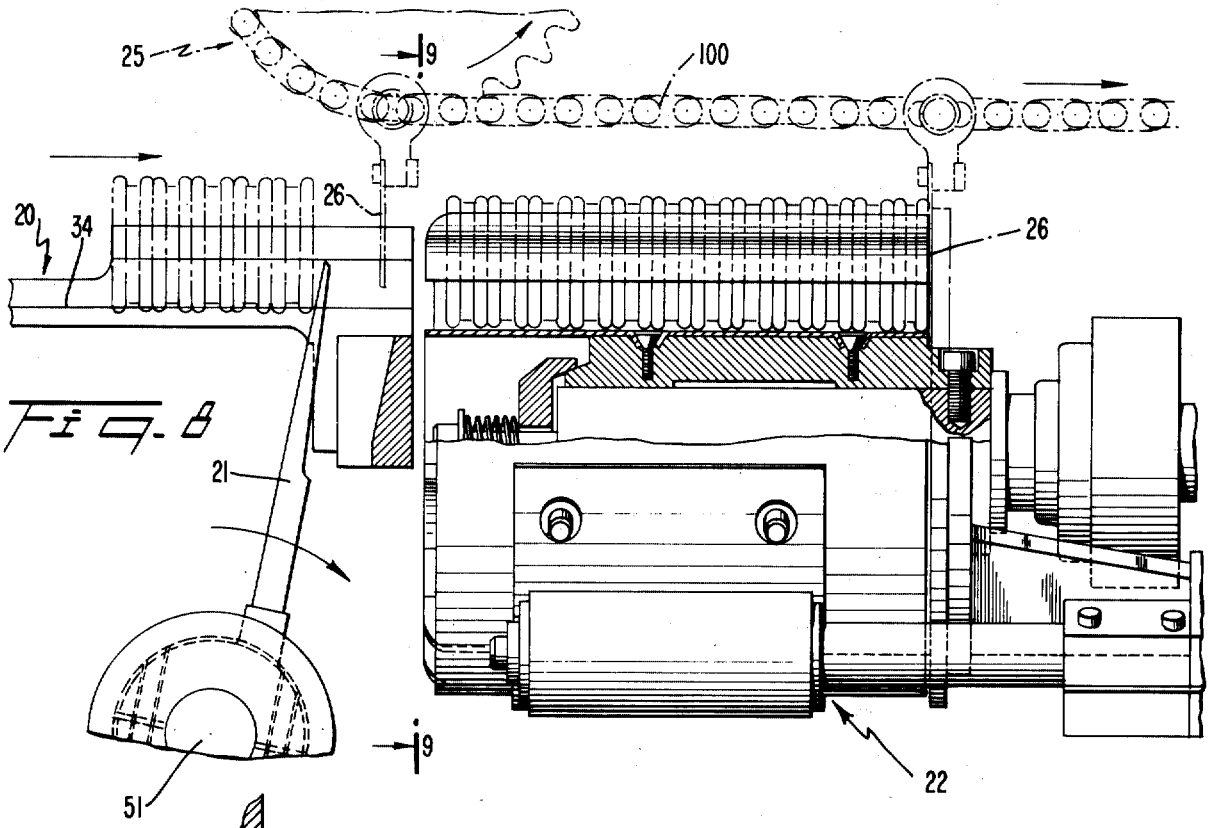

Each pair of rails extend to a turret 22 which is formed with six column receiving recesses 24. The turrets periodically rotate about an axis parallel to the rails and the turrets are positioned to align the recess 24 in the top position with the rails 20, as shown in FIG. 7.

Figure 5:
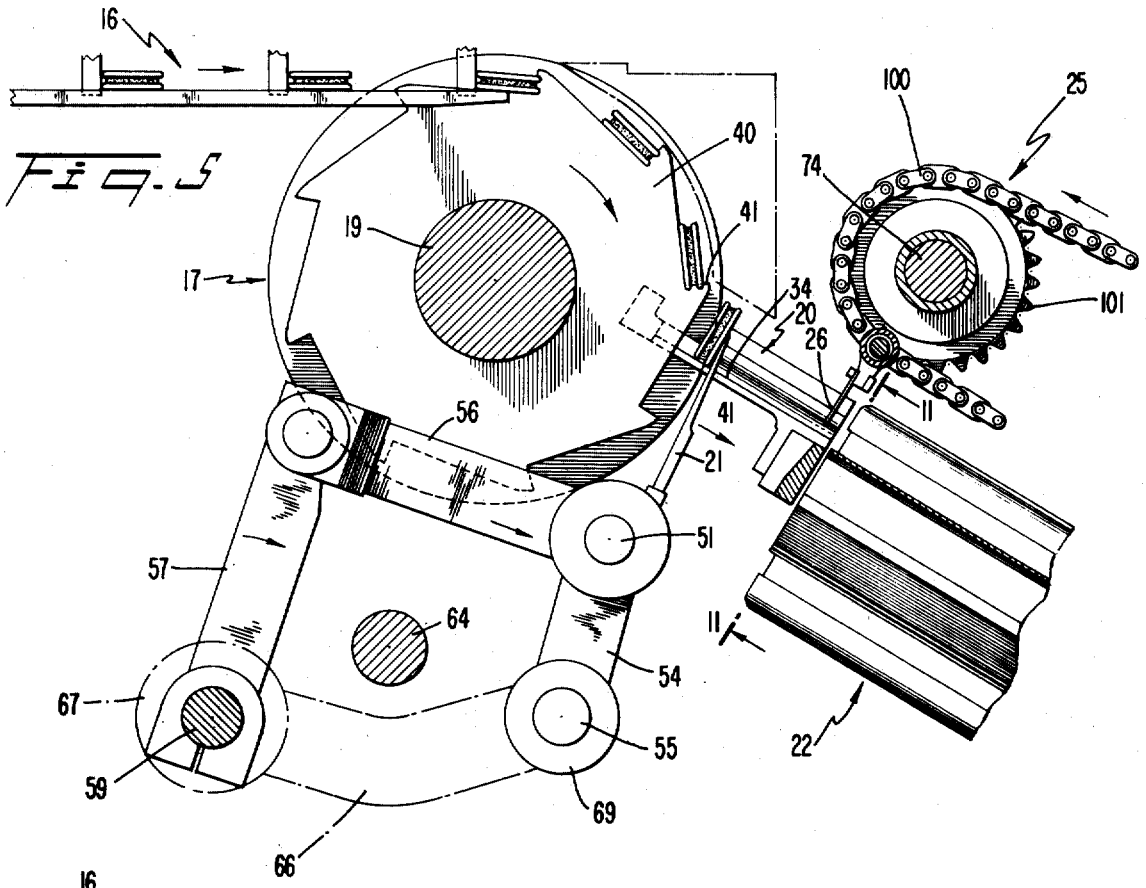
Figure 6:
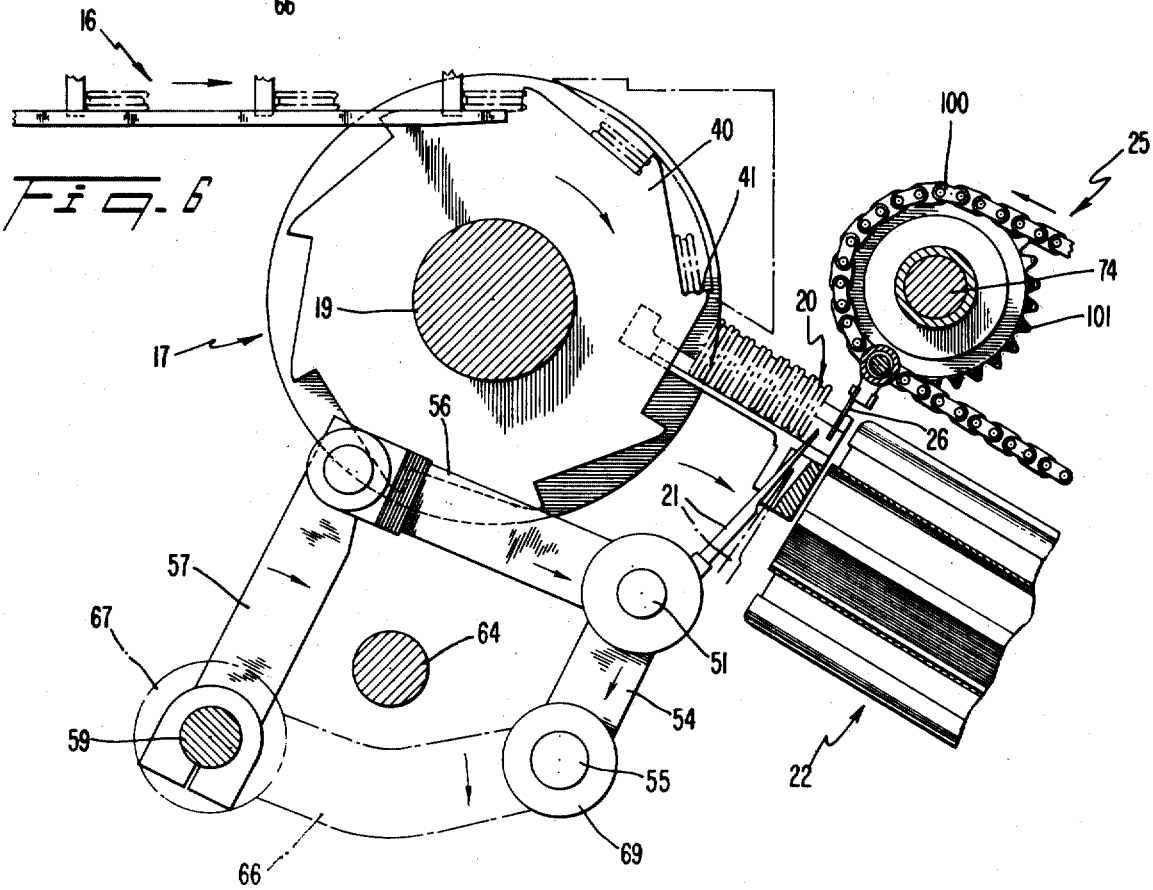

An overhead conveyor 25 is positioned above the turrets for transferring the columns of cookies from the rails into the top turret recess. The conveyor 25 includes a set of cookie engaging plates 26, one of which is positioned at the upper end of each turret (as shown in FIG. 5) as the column is being formed on the rails 20. When, as shown in FIG. 6, a predetermined number of cookies are stacked on the rails (for example 8 cookies), the finger 21 is moved downwardly between the rails out of engagement with the cookies. The plates 26 are formed with a downwardly facing notch (seen in FIG. 9) through which the end of the finger 21 passes as it retracts to smoothly transfer the support of the cookie stack to the plate 26.

Figure 9:
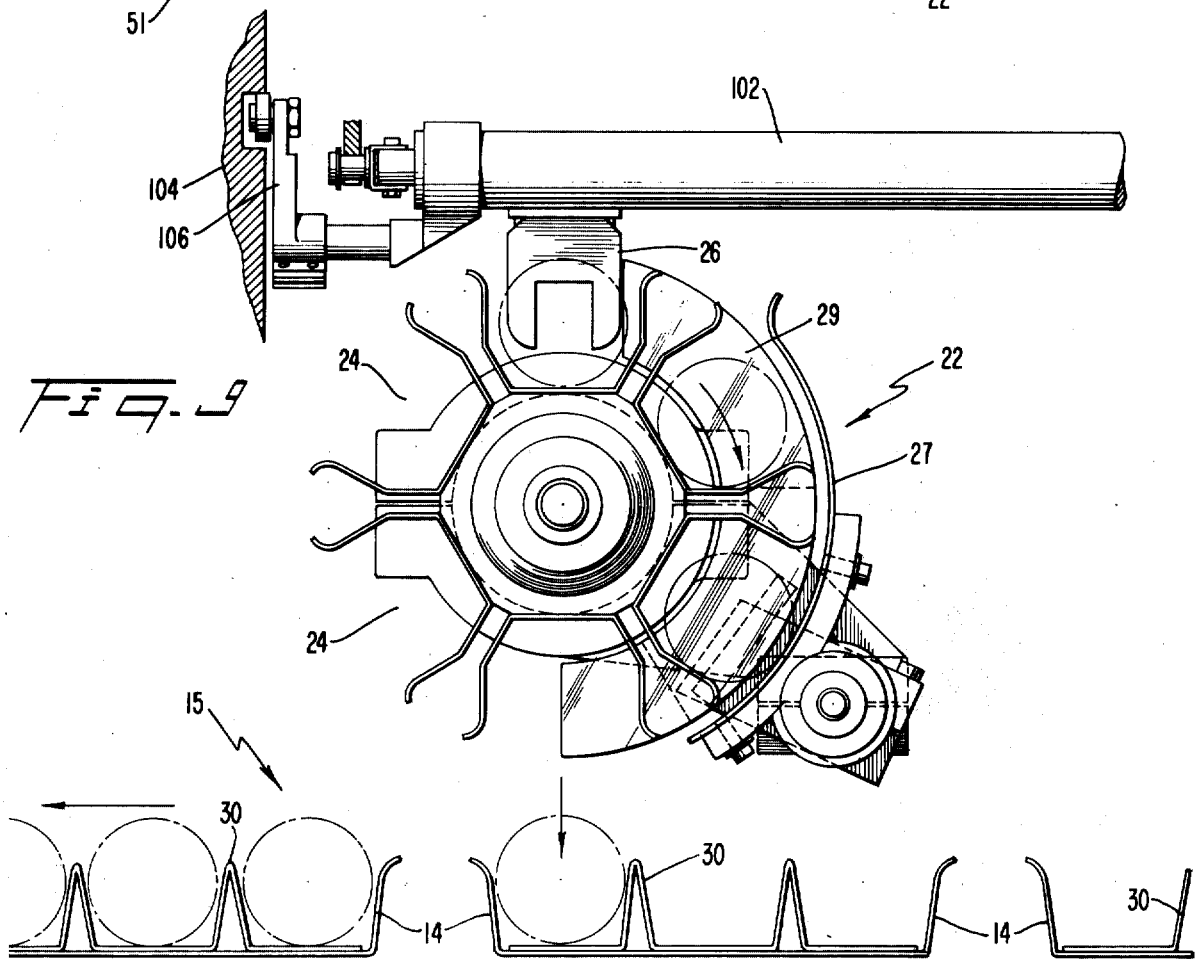
FIG. 9 is a sectional view taken along line 9—9 of FIG. 8.

The conveyor 25 is started at this point and the plate 26 moves into the top turret recess as additional cookies are added to the column. The conveyor moves at a rate which matches the growth of the column until the column includes a pre-selected number of cookies. As the column is being completed, the finger 21 is moved back toward the stacking wheel. Upon completion of the column, the finger is moved upwardly between the rails into the position shown in FIG. 5 to engage the end cookie of the next column to be formed. At this point, the conveyor 25 accelerates and rapidly moves the column into the turret recess as shown in FIG. 7. The plate 26 stops at the lower end of the turret and supports the column while the turret rotates to the next position. As shown in FIG. 9, an arcuate stop plate 27 is positioned at the bottom end of the turret and a curved plate 29 extends along the side of the turret. The plates 27 and 29 cooperate to retain the columns of cookies within the recesses while they are moved in steps from the top position to the bottom position. As each recess is moved into the bottom position, the column of cookies therein falls into a bucket 14 of the conveyor 15. A folded corrugated paper divider 30 is normally positioned in each bucket 14 to divide the bucket into three sections.

In the present invention, the turrets 22 and overhead conveyor 25 are not changed when the apparatus is adjusted to handle a different cookie count or cookies of different thickness. The turret 25 is constructed to have a length sufficient to accept the longest cookie column to be handled by the apparatus. The plates 26 on the conveyor 25 are spaced at a distance slightly greater than the length of the turret. Instead of relying on positioning one of the conveyor plates 26 at the upper end of the column to hold the cookies upright on the rails, the rails are provided with a compressed air arrangement to maintain the cookies in an upright position.

Referring to FIGS. 11 to 14, the rails 20 of each pair are mirror images of each other and each include an elongated main body 31 having a loading section 32 and a stacking section 34. The bodies have inwardly facing curved surfaces 35 extending longitudinally along the sections 32 and 34. A formation 36 containing an air jet port 37 extends from the upper end of the loading section 32 and an air manifold bar 39 is mounted on the stacking section 34. The stacking wheels are each positioned between the bodies 31 of a pair of rails and each include a pair of serrated plates 40 which are spaced sufficiently to permit the serrations 41 to support cookies.

The bodies are provided with a main transverse passageway 42 which is supplied with compressed air by a tube 44. A longitudinal passageway 45 extends from the main passageway 42 to a vertical passageway 46 to supply the port 37. A passageway 47 extends vertically from the main passageway to the manifold bar 39. The bar 39 is formed with an elongated manifold recess 49 in its lower surface and a series of port grooves 50 extending outwardly from the recess at an angle.

Referring again to FIG. 5, when the first cookie of a column is deposited on the rails, the finger 21 is positioned near the end of the stacking sections 34 of the rails. The jet of air issuing from the port 37 strikes the cookie and slides it down the rails against the finger. As the finger 21 moves toward the turret, the air jets issuing from the port grooves 50 push the cookies in the column toward the turret and hold them in a position perpendicular to the rails.

Figure 15:
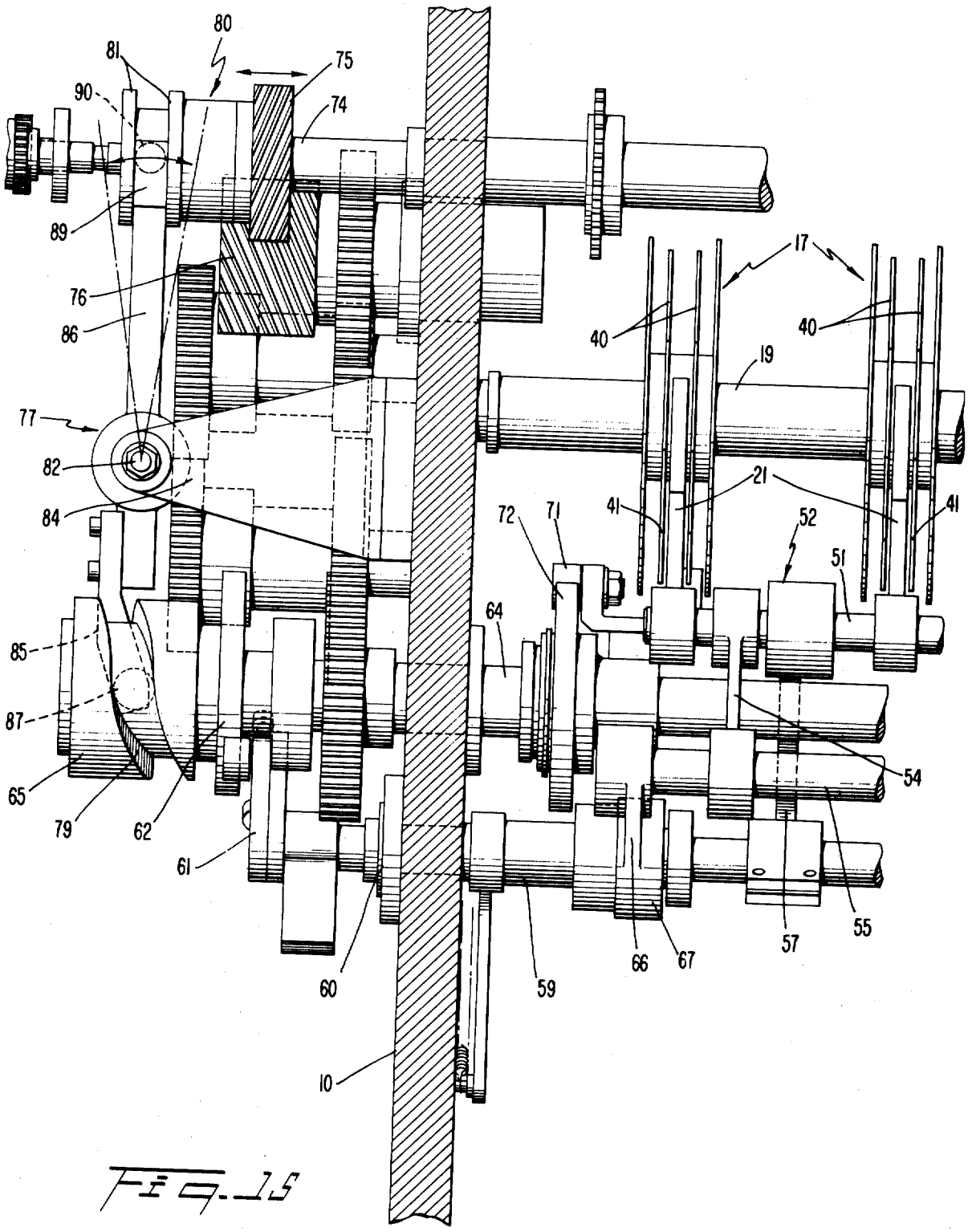
FIG. 15 is a sectional view along line 15—15 on FIG. 2.

The fingers 21 are rigidly mounted on a shaft 51 which is moved parallel to the rails by a jointed arm 52 (FIGS. 4 & 10) and is rotated and moved perpendicular to the rails by links 54 extending from a shaft 55. The arm 52 includes members 56 and 57 which are pivotally attached at one end and interconnect the shaft 51 with a shaft 59. The member 56 is pivotally attached to the shaft 51 while the member 57 is rigidly attached to the shaft 59. The shaft 59 is journalled in the frame plates 10 and 11 by means of bearings 60 as shown in FIG. 15. A cam follower arm 61 (FIGS. 10 & 15) is rigidly attached to the shaft 59 and engages a cam element 62 mounted on a driven shaft 64.

Figure 10:
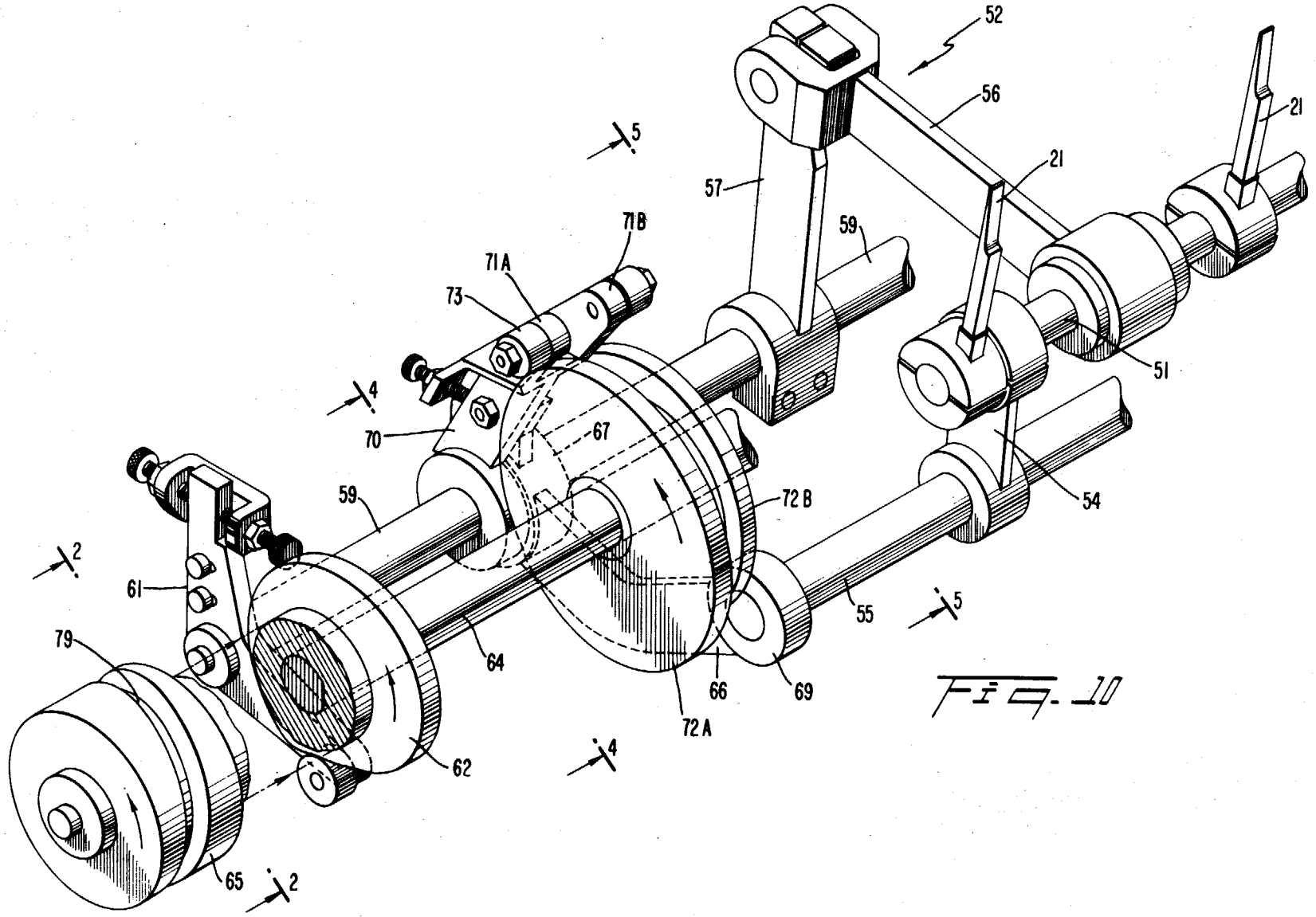
FIG. 10 is an isometric view of the mechanism for controlling the column supporting finger.

Referring to FIG. 10, rotation of the shaft 64 rotates the cam element 62 causing the cam follower arm 61 to rock the shaft 59. The rocking of the shaft 59 moves the jointed arm 52 to move the fingers 21 in an arc about the axis of shaft 55 to provide motion along the rails. The greater the angular displacement of the shaft 59, the greater the horizontal movement of the fingers. The cam element 62 is, therefore, matched to the length of the column of cookies. The cam element 62 is formed as an integral part of a barrel cam 65 which is locked to the shaft 64. The barrel cam 65 controls the operation of the overhead conveyor 25 as described hereinafter in detail.

The shaft 55 (FIG. 10) is supported by at least two arms 66 which are mounted upon hubs 67 that are journalled upon the shaft 59. The shaft 55 is journalled in bearings 69 provided on the end of the arms 66 so that the shaft 51 (carrying the fingers 21) is rotated about the axis of shaft 55 as the jointed arm 52 responds to limited rotation of the shaft 59.

The hubs 67 are journalled upon the shaft 59 and are provided with cam follower arms 70. The arms 70 each have a forked end with fingers 71A and 71B. A pair of cam wheels 72A and 72B are mounted on the shaft 64. A roller 73 is mounted on one of the fingers 71 to engage one of the cams 72. Rotation of the shaft 64 thus causes the shaft 55 to be raised and lowered by the arms 66 according to the contour of the cam wheel 72 in use.

Figure 4:
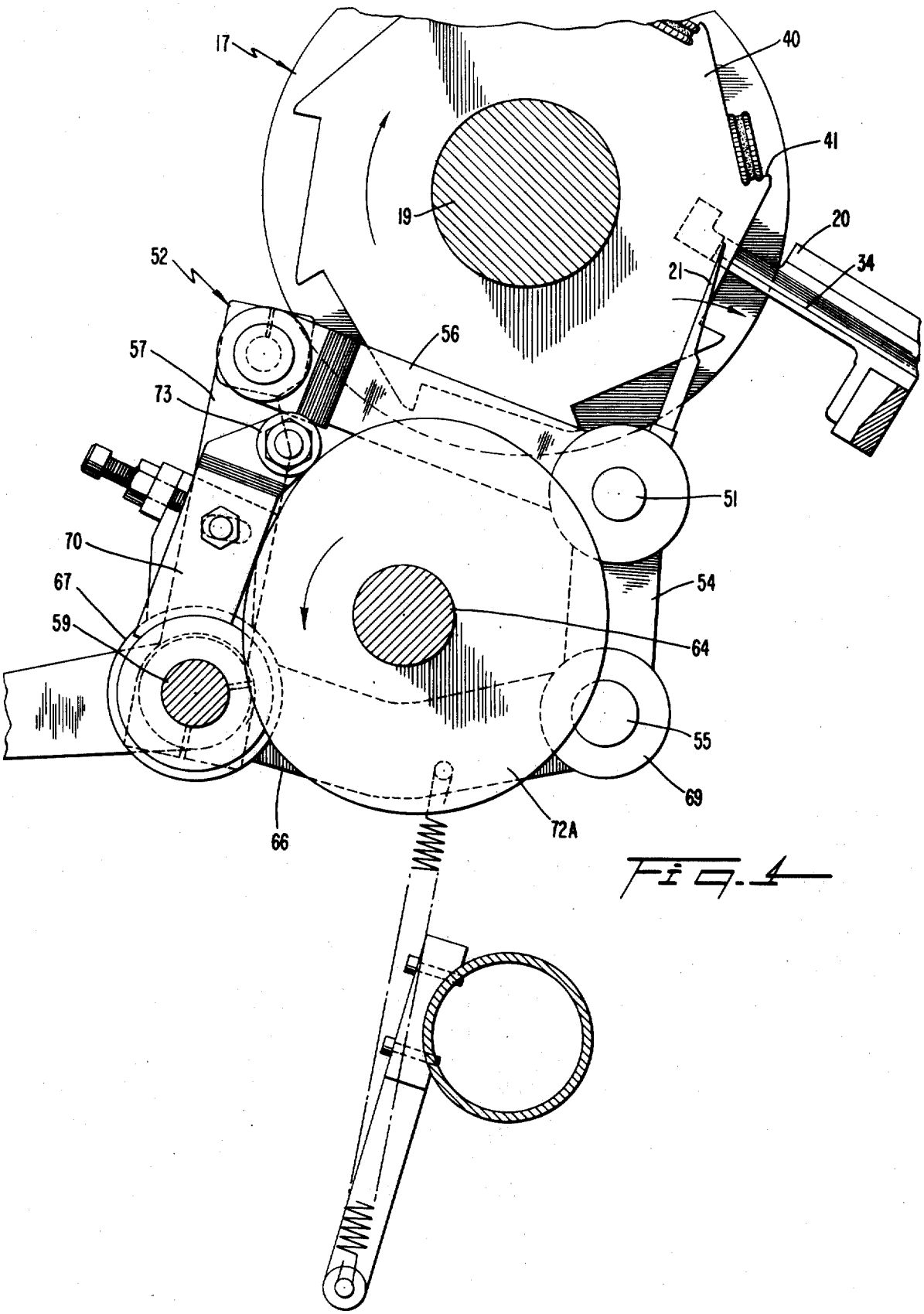
FIGS. 4, 5, 6, 7 and 8 are sectional views each taken along the line A—A FIG. 1 showing a sequence of operation of the apparatus of FIG. 1.

Referring to FIGS. 4 to 6, when the shaft 59 rotates clockwise, the link 54 rotates about the axis of shaft 55 moving the fingers along the rails. When the fingers reach the position shown in FIG. 6, the cam 72 lowers the arm 66 to move the fingers below the column of cookies. The cam 72 must now keep the fingers below the rails as the fingers are brought back to the stacking wheel 40. The cam 72A is used in connection with relatively short columns of cookies while the cam 72B is used for long columns. The cam 72B is formed to position the fingers 21 below the rails for a greater portion of a cycle to allow the greater number of cookies to move down the rails.

Figure 16:
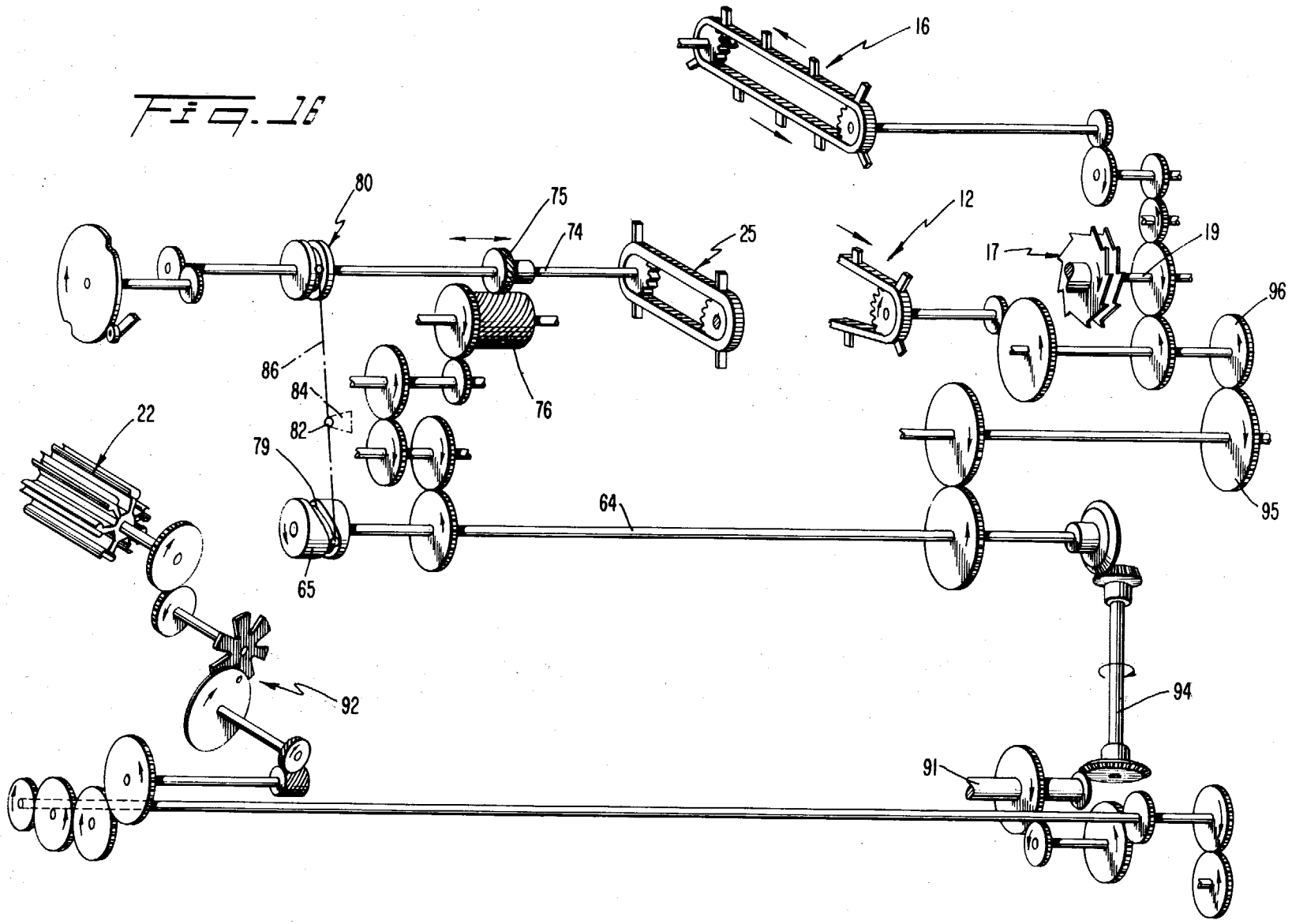
FIG. 16 is a schematic drawing of the drive trains of the apparatus of the invention.

Referring now to FIGS. 15 and 16, the overhead conveyor 25 is driven by a shaft 74 on which is mounted a helical gear 75. The gear 75 is splined to the shaft 74 to be moveable longitudinally along said shaft. The helical gear 75 is driven by a second helical gear 76 which is of the same diameter but is considerably longer. The speed of the shaft 74 is controlled by moving the gear 75 along the shaft to provide relative axial motion between the two helical gears. When the gear 75 is moved so that its teeth move along the face of the gear 76 at the same rate (and is the same direction) that the teeth of the gear 75 advance along the face of the gear, then the gear 75 is not rotated by the gear 76. Axial movement of the gear 75 at a lesser rate causes the gear 75 to be driven at a speed which increases as the rate of axial movement of the gear 75 departs from the aforementioned non-driving rate.

The axial movement of the gear 75 is controlled by the barrel cam 65 through a lever 77. The barrel cam 65 is provided with a cam groove 79. The gear 75 is mounted on a cylindrical formation 80 provided with a pair of spaced circular flanges 81. The lever 77 is pivoted upon a pin 82 supported by a frame mounted bracket 84. The lever 77 is provided with lower and upper arms 85, 86. The lower arm 85 carries a roller 87 which is positioned in the cam groove 70. The upper arm 86 carries a yoke 89 provided with a pair of rollers 90 which ride between the flanges 81. The shaft 64 makes one revolution for each column of cookies which are assembled. The movement of the conveyor 25 is controlled by the movement of the gear 75 relative to the gear 76. The cycle of conveyor 25 includes a period during which the conveyor is motionless while the finger 21 is supporting the growing column, a period of relatively slow movement while the column is being completed, and a period of rapid movement as the completed column is moved into the turret recess. The relative length of each period during the cycle is determined by the contour of barrel cam. The motionless period is the same in all cases and corresponds to the time required to place eight cookies on the rails. The duration of the slow motion period is increased when the column length is increased.

The power train of the apparatus is shown in FIG. 16. The main power shaft 91 drives the turret 22 (in steps) through a series of gears and a geneva wheel arrangement 92. The shaft 64 is driven through a vertical shaft 94 and the helical gear 76 is driven from the shaft 64 through a gear train. The infeed conveyors 12, the transfer conveyors 16 and the stacking wheels 17 are driven from the shaft 64 through a series of gears including a pair of removeable gears 95 and 96 which are replaced when it is desired to change the number of cookies in the completed columns. The gears 95 and 96 control the number of cookies counted out by the stacking wheels during each cycle of the machine.

Figure 1:
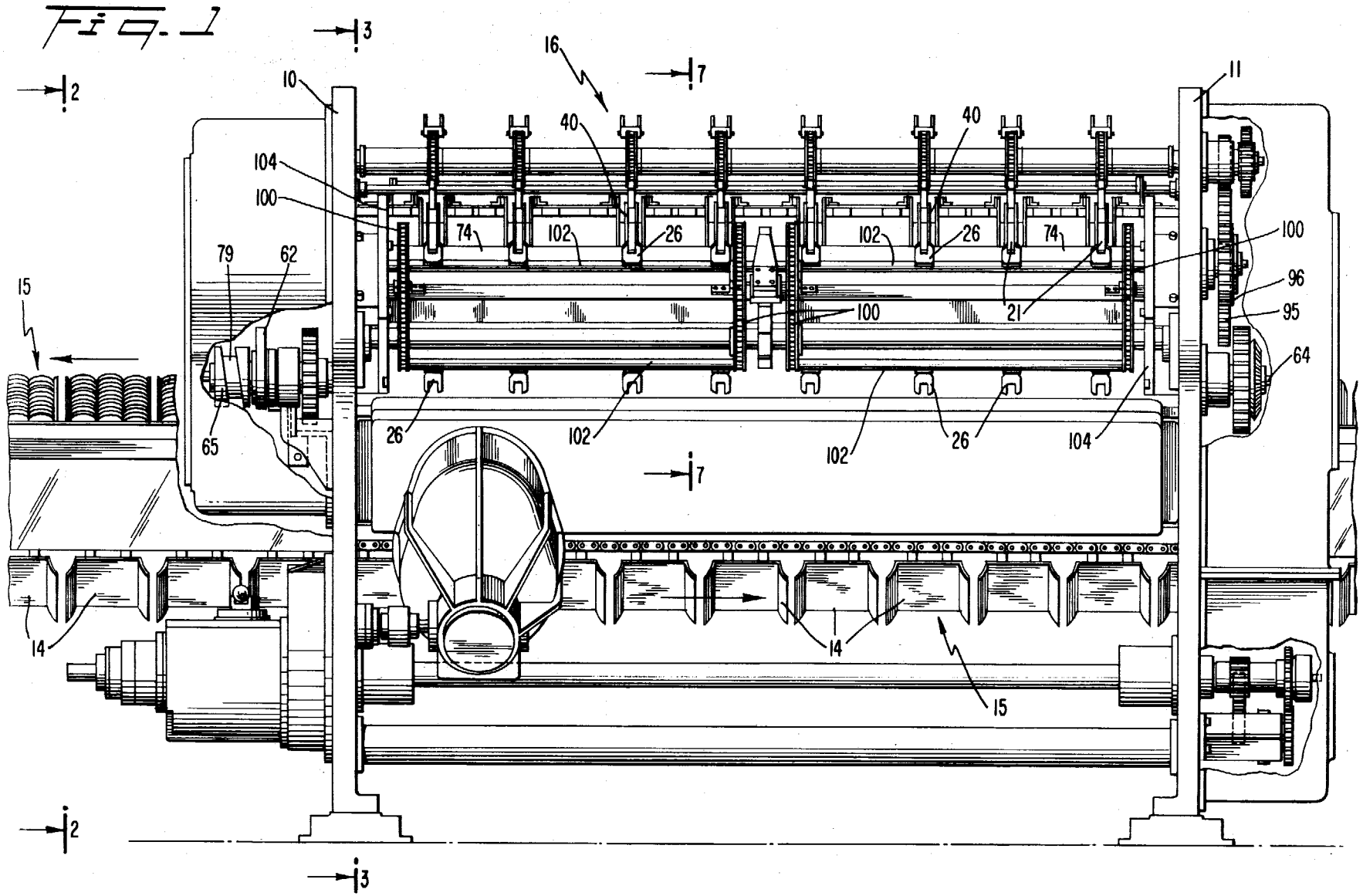
FIG. 1 is a front elevational view of apparatus according to the present invention.
Figure 2:
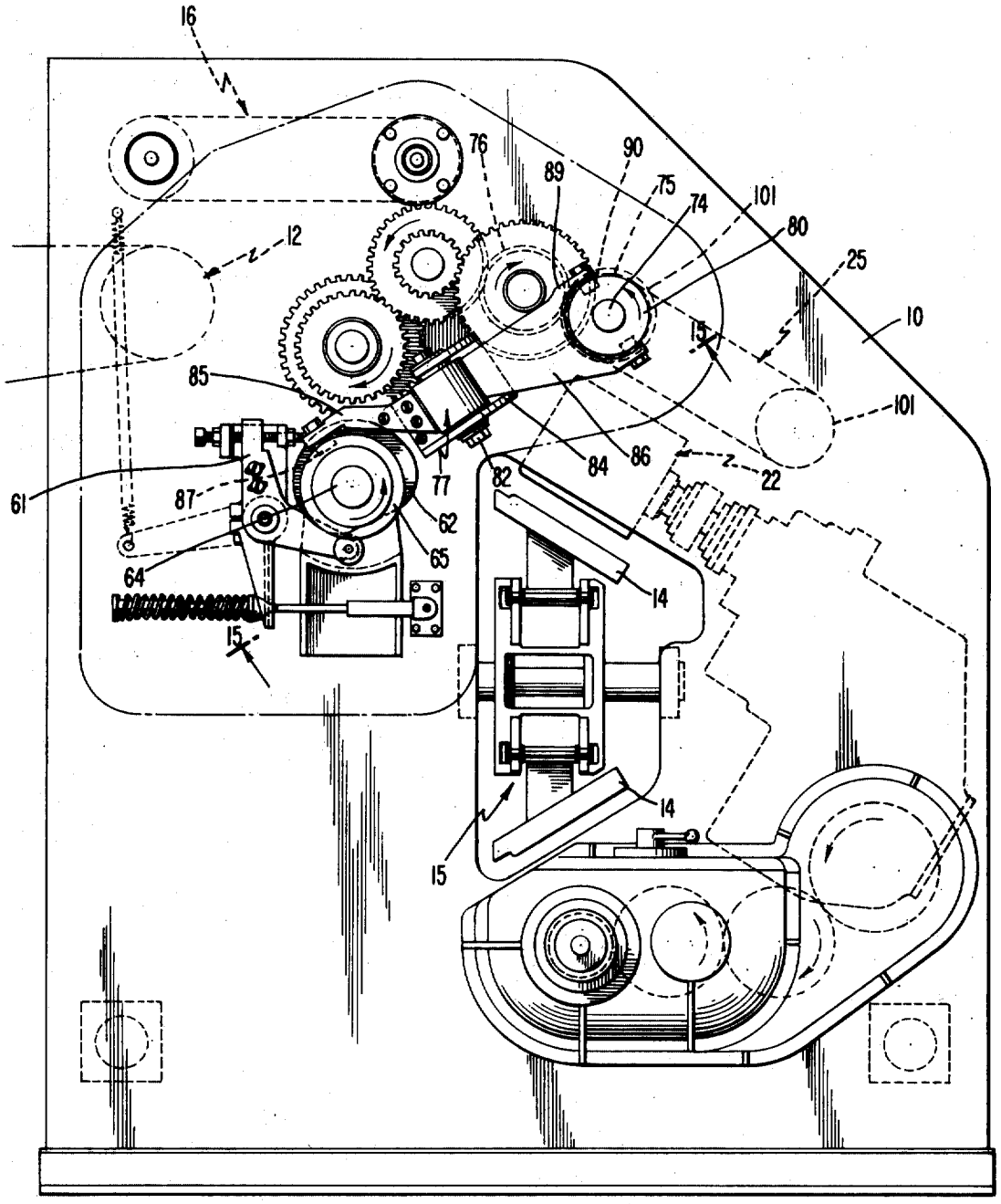
FIG. 2 is left side elevational view of the apparatus of FIG. 1 with the gearing cover removed.

Referring to FIGS. 1 and 7, the overhead conveyor 25 is divided into two sections each having an endless chain 100 at each end thereof carried by sprockets 101. Rods 102 extend between the chains and carry the plates 26. A plate 104 having a cam groove 105 is mounted to each of the end frame plates 10 and 11. A cam follower 106 mounted on each rod 102 engages the groove 105 to control the orientation of the plates 26 so that they are parallel to the cookies as they move through the area of the turret.

In order to change over the article stacking and loading apparatus of the present invention to handle a column of cookies of a different count or different thickness, it is necessary only to change the barrel cam unit 65 (which includes the cam 62), to change the gears 95 and 96, and to move the cam roller 72 to the other finger 71 if the length of the column is changed significantly. This modification can be accomplished in about one hour.

It can be seen from the foregoing, that the present invention provides article stacking and loading apparatus which is capable of rapid modification to form and handle article stacks having different characteristics.

I claim:

1. Article stacking and loading apparatus comprising a pair of inclined rails, a wheel device for placing flat articles on edge on said rails, said wheel device having elements spaced around the periphery thereof for carrying flat articles oriented generally perpendicular to radii of the wheel device, nozzle means for directing a jet of air generally parallel to said rails against each article as that article is transferred from the wheel to the rails, air nozzle means provided along said rails for sliding the articles along the rails and maintaining them in an upright condition, a turret rotatable about an axis parallel to said rail means having a plurality of recesses for receiving columns of articles, a finger mounted for movement along said rails to said turret for engaging the first article in a column being formed to support the column, and conveyor means adjacent said turret having projecting members equally spaced at a distance comparable to the length of the turret for supporting each column and moving the columns into the turret recesses.

2. Apparatus according to claim 1 wherein said wheel device includes a pair of serrated plates mounted for rotation about a common axis, the individual serrations each having a flat generally radial surface, the serrations on said pair of wheels being aligned with each other, and said plates being spaced from each other to permit individual articles to be supported by each pair of aligned serrations.

3. Apparatus according to claim 2 wherein said nozzle means is positioned between said common axis and the inner edge of the radical surface of said serrations and adjacent to the serrations to move the articles along said rails immediately when the articles contact the rails.

4. Apparatus according to claim 3 wherein said rails extend on either side of said pair of serrated plates.

5. Apparatus according to claim 4 wherein said nozzle means includes means providing a nozzle at the end of each of said rails.

6. Apparatus according to claim 5 wherein each rail of said pair includes a bar member having a curved surface extending along the length thereof, said curved surface facing upwardly and inwardly for supporting said articles.

7. Apparatus according to claim 6 wherein said means providing a nozzle includes a block member mounted to the inner end of each rail bar member and extending upwardly perpendicular to said bar member, a port formed in said block member above said curved surface, and passageway means in said bar and block members for supplying compressed air to said port.

8. Apparatus according to claim 7 wherein said bar member includes a loading section and a stacking section, said loading section being adjacent to said stacking wheel device and said stacking section being adjacent to said turret, said stacking section being provided with means providing a series of air ports positioned to operate against the edges of articles positioned in the stacking section to hold them perpendicular to said rails.

* * * * *